US005462507A

United States Patent [19]

Nichols, Sr. et al.

[11] Patent Number: 5,462,507

[45] Date of Patent: Oct. 31, 1995

[54] APPARATUS FOR DOCKING AN EXERCISE MACHINE

[75] Inventors: Raymond L. Nichols, Sr.; Raymond L. Nichols, II, both of Cleveland, Tenn.

[73] Assignee: Southern Xercise, Inc., Cleveland, Tenn.

[21] Appl. No.: 192,452

[22] Filed: Feb. 7, 1994

[51] Int. Cl.[6] ..... A63B 21/06

[52] U.S. Cl. ..... 482/104; 482/93; 482/130

[58] Field of Search ..... 482/104, 137, 482/108, 130, 134; 484/104, 137, 108, 130, 134

[56] References Cited

U.S. PATENT DOCUMENTS 4,336,934 6/1982 Hanagan et al. ..... 482/97
4,621,810 11/1986 Cummins ..... 272/134
4,650,186 3/1987 McCreery et al. ..... 482/104
4,872,670 10/1989 Nichols ..... 272/134
5,108,095 4/1992 Nichols ..... 482/137

*Primary Examiner*—Stephen R. Crow
*Assistant Examiner*—Jerome Donnelly
*Attorney, Agent, or Firm*—Paul E. Hodges

[57] ABSTRACT

Apparatus for docking of an exercise machine wherein the control over the docking activity is under the control of the user, employing means other than those limbs of the user which are primarily engaged in the grasping and physical movement of the movable component of the machine, and including at least one dock which is frictionally engaging with the movable component, activator means actuated by the user to impart stored energy in a connector means disposed between the dock and the activator whereby upon disengagement of the movable component from the dock, the stored energy in the connector means effects movement of the dock from its docking position with respect to the movable component. A method for controlling the docking is disclosed.

6 Claims, 3 Drawing Sheets

APPARATUS FOR DOCKING AN EXERCISE MACHINE

FIELD OF INVENTION

This invention relates to exercise machines and particularly to exercise machines which include one or more moving components thereof which require means for limiting their movement in one or more directions. More especially, this invention relates to a method and apparatus for docking a component of an exercise machine in an at rest position, especially where the component contains stored energy.

BACKGROUND OF THE INVENTION

Various exercise machines include one or more movable components. The movement of these components is under the control of the user. For example, a simple barbell is at rest when on the floor or when resting in the upright supports found on a bench press apparatus. Effectively, the barbell is biased toward its at rest position by gravity acting upon the barbell. The user grasps the barbell and lifts to begin an exercise routine. Upon completion of the exercise routine, the user returns the barbell to the floor or the upright supports where the barbell remains biased against movement away from its docking position. Modern exercise machines, however, include one or more moveable components which commonly are biased by free weights, hydraulic systems and the like toward their individual docking positions, that is their at rest positions. The user of the machine begins an exercise routine on such an apparatus by first positioning himself or herself with respect to the apparatus and then applying force to the moveable component sufficient to move the component away from its docking position and then through some range of motion which exercises the muscles of the user. At all times during the exercise, the movable component remains biased toward its docked (at rest) position, so that the first effort by the user of the apparatus when commencing an exercise routine is a substantial exertion of force against the movable component as causes the component to overcome its inertia. This concept is generally referred to in the art as starting an exercise routine from the "closed position". The term "closed position" also most commonly implies that the limbs of the user are in their maximum position of extension (adduction or abduction or rotation, depending upon the type of exercise) and therefore the user's muscles and joints are stressed the greatest. In like manner, when the user completes the exercise routine and is relatively tired, the moveable component must be controllably returned to its docking position. This effort, again requires the user to move their limbs to a maximum position of extension, etc. and at a time when the user has expended substantial energy completing the exercise routine and their muscles are tired. Accordingly, both the starting and ending activities of the exercise routine subject the user to the danger of the biasing force of the exercise apparatus violently overcoming the strength of the user and resulting undue strain on the user's muscles and joints, or in more serious injury to the user.

It has been suggested in the art that certain exercise routines should be commenced in the "open position" as a precaution against undue initial strain upon the user at the commencement of an exercise routine when the user has yet to be "warmed up". The "open position" in this situation refers to the movable component of the exercise machine, at the start of an exercise routine, being disposed at the upper limit of its range of anticipated movement during the exercise routine. That is the component will be docked at its upper limit of its range of movement. It will be recognized that in this position of the movable component, the component will be docked in its fully biased attitude and once released from its docking, the component must be under the full control of the user. Thus, it becomes most important that the user have full and complete control over the release of the movable component from its docked position. Further, it is likewise important that the docking be of a type which precludes inadvertent release of the biased movable component to thereby ensure the safety of both the user and/or persons incidentally associated with the apparatus.

Further, in those exercise apparatuses which require the user to use both of their hands to grasp the movable component or components of the apparatus to carry out the exercise routine, it is desirable, and even required in certain apparatus, that the release of the docking of the movable component be controllable by other than the hands of the user. Still further, it is of importance that the docking be such that when the user has completed an exercise routine, the movable component may be readily docked, again without requiring the use of the hands of the user.

In certain exercise apparatus, it is desirable that the docking position of the movable component of the exercise apparatus be at an intermediate position, that is, at a position between the minimum and maximum limits of movement of the movable component. In this situation, after the user has released the movable component from its dock, it is required that the dock remain out of its docking position until the user has completed their exercise routine, but that the dock be readily returnable to its docking position under the control of the user.

It is therefore an object of the present invention to provide a method for docking one or more of the movable components of an exercise machine.

It is another object of the present invention to provide apparatus for docking one or more of the movable components of an exercise machine.

It is another object of the present invention to provide a method and apparatus for docking one or more of the movable components of an exercise machine wherein the dock is fully under the control of the user of the machine.

It is another object of the present invention to provide a docking apparatus which permits control of the dock by means other than the body member or members which are primarily used to control the movement of the movable component of the exercise machine.

It is another object of the present invention to provide a method and apparatus for docking one or more of the movable components of an exercise machine and which provides protection against inadvertent release of the dock from its position of support for the movable component or components.

It is another object of the present invention to provide a method and apparatus for docking one or more of the movable components of an exercise machine and wherein the dock may be located at substantially any position between the minimum and maximum limits of movement of the movable component or components.

Other objects and advantages of the present invention will be recognized from the following description, including the claims in which:

SUMMARY OF THE INVENTION

Figure 1:
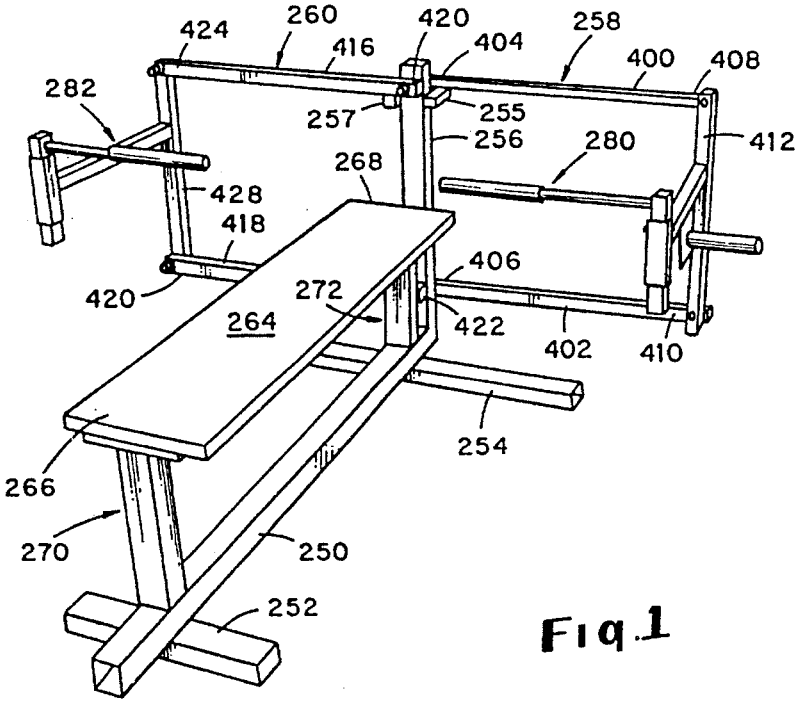
FIG. 1 is a representation, in perspective, of one embodiment of an apparatus for exercising from the supine position and providing for flexion and extension movement of the humerus.
Figure 2:
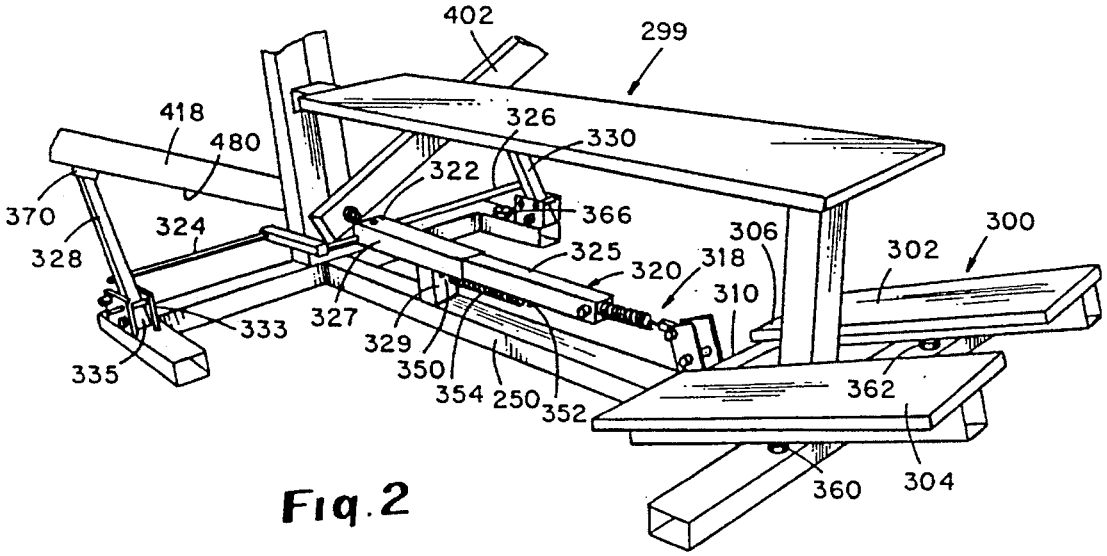
FIG. 2 is a representation of one embodiment of a docking mechanism which is particularly suitable for use with the apparatus depicted in FIG. 1, and depicting various of the features of the present invention.
Figure 3:
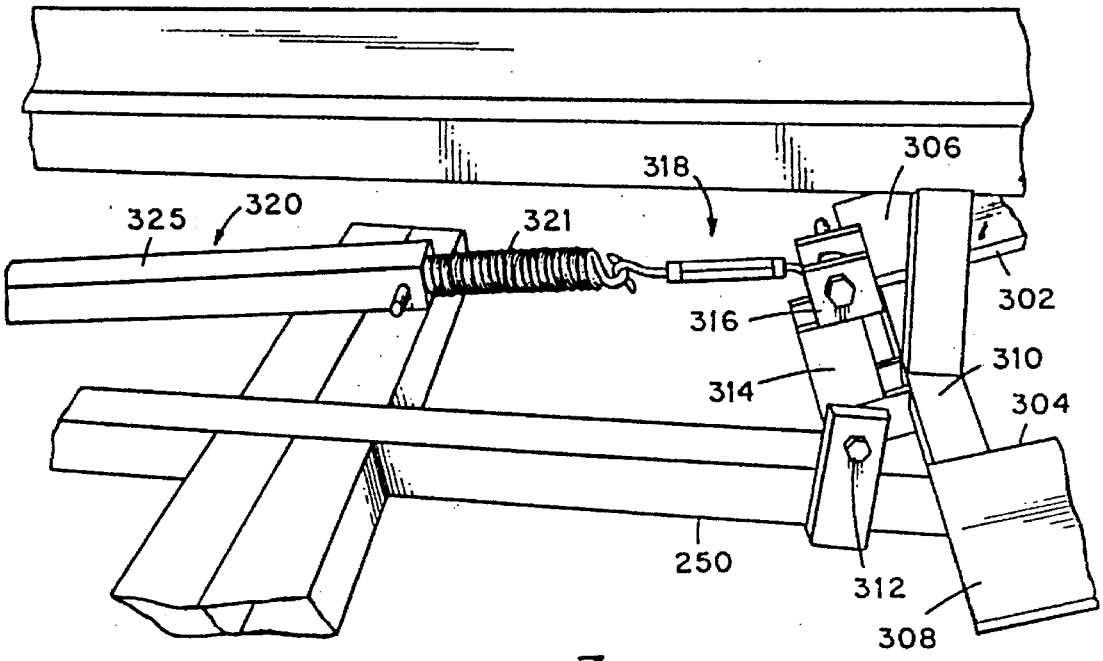
FIG. 3 is representation of the forward portion of the docking mechanism depicted in FIG. 2.
Figure 4:
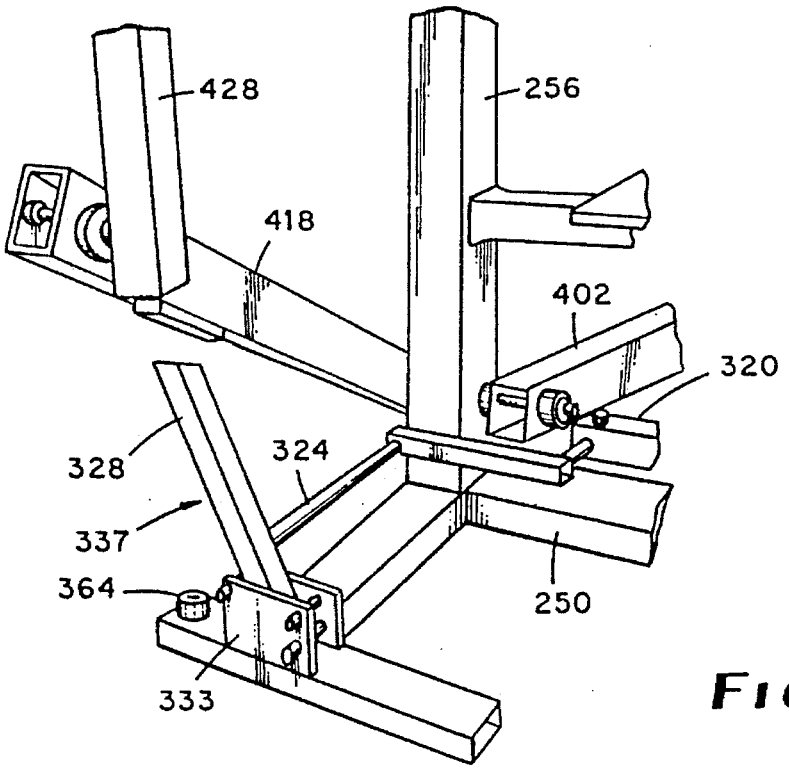
FIG. 4 is a representation of a portion of the rear, left-side, of the docking mechanism of FIG. 2.
Figure 5:
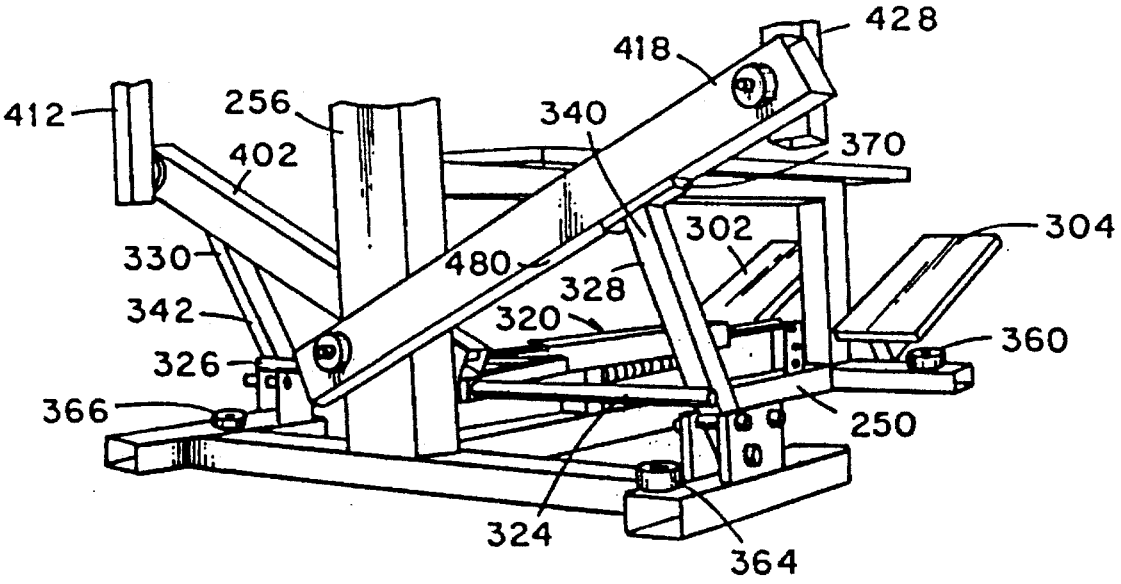
FIG. 5 is a representation of the read end of the docking mechanism of FIG. 2.

Briefly stated, the present invention comprises a method and apparatus for docking one or more of the biased movable components of an exercise machine, wherein the control over the docking activity is under the full control of the user, employing means other than those limbs of the user which are primarily engaged in the grasping and physical movement of the movable component or components. In one embodiment of the apparatus of the present invention, there is provided a dock disposed in position to restrain the movement of the movable component or components against the biasing force exerted by the component or components, the dock being mounted in frictional engagement with the component or components and for movement between docking and nondocking positions with respect to the movable component or components and biased toward its docking position, an activator which is engagable by the user for activating and deactivating the movement of the dock between its docking and nondocking positions, and a connector mechanism interposed between the activator and the dock, the connector mechanism including a first member engaging the dock and suitable for moving the dock toward its nondocking position, a second member linking the first member to the activator, this second member being in the nature of a coiled spring having a first resistance to extension thereof, and a third member biasing the connector mechanism toward a position wherein the connector mechanism permits the dock to return to its docking position, the third member being in the nature of a coiled spring having a second resistance to extension, the resistance to extension of the first member being greater than the resistance to extension of the second member whereby actuation of the activator by the user imposes a bias upon the connector mechanism which is insufficient to overcome the combination of the bias of the dock toward its docking position and the frictional forces between the dock and the movable component or components until the user has purposefully moved the movable component or components away from and out of frictional engagement with the dock, but which is sufficient to overcome the resistance to extension of the second member and thereby prevent the second member from moving the connector mechanism to a position wherein the dock may return to its docking position until the user has released the activator and thereby released the force exerted upon the connector mechanism by the first member to permit the force exerted upon the connector mechanism by the second member thereof to move the connector mechanism to a position wherein the dock may return to its docking position.

In accordance with the method of the present invention, the docking of one or more of the biased movable components of an exercise machine is effected by the steps of providing a dock in position with respect to the movable component or components to limit the movement of the component or components against the bias thereof, providing an activator accessible to the user by a body part not primarily involved in the physical movement of the movable component or components of the exercise machine, providing a connector mechanism between the dock and the activator, interconnecting the activator with the connector mechanism employing a first member having a resistance to extension which is insufficient to overcome the resistance to movement of the dock from its docking position when the dock is frictionally engaged by the movable component or components, but which is sufficient to move the connector mechanism to effect movement of the dock away from its docking position when the user moves the movable component or components out of frictional engagement with the dock.

DETAILED DESCRIPTION OF INVENTION

Referring now to the Figures, and initially to FIG. 1, the present invention is depicted as being applied to an exercise machine 299 which is designed to exercise the upper torso of a user while the user is in a supine position. A complete description of the depicted exercise machine, and equivalent exercise machines, is found in our copending application which is filed contemporaneously with the present application, now Ser. No. 08/192,446, filed Feb. 7, 1994, entitled: UPPER TORSO EXERCISE METHOD AND APPARATUS. This copending application is incorporated herein in its entirely by reference..

Briefly the exercise machine 299 depicted in FIGS. 1–5 comprises a base 250 which provides support for a bench 264 on which the user reclines, first and second sets of outrigger arms 258 and 260 which are pivotally mounted on an upright 256 which is, in turn, mounted on the base 250. In this exercise machine, the docking is chosen to be effected in cooperation with the lowermost arms 402 and 418 of the two sets of outrigger arms.

In the embodiment of the present docking apparatus depicted in FIGS. 1–5, the apparatus includes first and second docks 328 and 330, each of which is pivotally mounted to the base 250 of the exercise machine 299 at a location at which the dock may be moved between a position underneath the arm 418 (docking position) and a position out from under the arm 418 (non-docking position). The depicted mounting of each dock includes an upstanding bracket 333 which services to receive and pivotally mount one end 335 of the dock. The angle of mount of the dock is chosen such that the dock is biased by gravity toward its docking position, indicated generally by the number 337 in FIG. 4. As desired, spring means or the like (not shown) may be used to bias the dock toward its docking position. The second dock 330 is mounted in like manner as described for the first dock 328 but on the opposite side of the post 256 and at a location at which the dock may be moved between a position underneath the arm 402 (docking position) and a position out from underneath the arm 402 (non-docking position).

As depicted, the apparatus further included an activator indicated generally by the numeral 300 and includes first and second footboards 302 and 304 which are fixedly connected to one another, so that they move in unison, as by means of a cross member 310. This cross member 310 is pivotally mounted to the base 250 and includes an upstanding post 314 which, at its outboard end 316 pivotally receives a first end 318 of connector mechanism 320. This connector mechanism 320, in the depicted and preferred embodiment, includes a coiled spring 321, but other extensible means which function or can be made to function in the nature of a coiled spring may be employed. The connector mechanism 320, in the depicted embodiment further includes an elongated rigid member 325 such as a metal tube. This rigid member 325 is slidably mounted above the base 250 as by means of a tubular mounting 327 that is supported above the base 250 by post means 329 and which slidably receives the tubular member 325 therethrough. The most rearward end 322 of the connector mechanism 320 has fixedly mounted thereon first and second arms 324 and 326 that extend laterally from the end 322 of the connector mechanism 320 such that the first arm 324 extends to a location adjacent to, and on the rearward side 340 of the dock 328, and the second arm 326 extends laterally from the end 322 of the connector mechanism 320 to a location adjacent to, and on the rearward side 342 of the dock 330. In these locations with respect to the docks, the arms 324 and 326 are in position to exert a forward movement (toward the foot pedals) to the docks when the connector mechanism 320 slides forwardly in its mounting 327 and effects forward movement of the arms 324 and 326, which in turn, urge the docks away from their docking positions. Rearward movement of the connector mechanism serves to move the arms 324 and 326 rearwardly to permit the docks to move by gravity to their docking positions.

In the depicted exercise machine, each of the sets of outrigger arms moves up and down independently of the other so that it is necessary to provide for docking of each set of outrigger arms. This is accomplished by providing two docks, one dock being associated with a respective set of outrigger arms. In other exercise machines, only one dock may be required.

An exercise cycle employing the depicted exercise machine depicted in FIG. 1 requires the user to grasp each of two handholds 280 and 282 with their hands—one handhold in each hand— so that the user's hands and upper limbs are not free to activate the release or engagement of the docks. To commence an exercise cycle in the open position using the depicted exercise machine requires that the two sets of outrigger arms be at or near the upper limit of their range of movement. Thus, the sets of outrigger arms must be docked at or near such upper limit. In performing an exercise cycle employing the depicted machine, the user is required to move the sets of outrigger arms from their initial upper limit position, downwardly to the extent desired by the user, thence return toward the upper limit. This cycle of movement of the sets of arms is repeated as many times as desired by the user to complete the exercise routine, whereupon the sets of arms must be raised to their upper limit and docked. This general routine is common to various exercise machines, including several of the embodiments depicted in applicants' copending application referenced hereinabove.

To effectively and safely dock the movable component or components of an exercise machine in the open position (wherein the movable component or components are biased to or near their maximum resistance level, requires that the dock not be movable away from its docking position until the user has positively acted to release the dock. Otherwise, the "loaded" movable component or components can drop or spring back in response to gravity or their stored energy and cause possible injury to the user. In accordance with the present invention, the dock is disposed relative to the movable component such that the dock opposes movement of the movable component when the dock is in its docking position. This dock is movable away from its docking position only after the taking of positive action by the user of the machine to release the dock for movement away from its docking position. In accordance with one aspect of the present invention, the dock is biased toward its docking position where the dock and movable component are in frictional engagement that tends to hold the dock in its docking position so long as the user has not moved the docked movable component out of such frictional engagement with the dock. This arrangement of the dock and the movable component ensures that the dock does not move out of its docking position until the user has complete control over the movement of the movable component. That is, in the depicted exercise machine, the user must grasp the handholds and push the sets of outrigger arms up and out of frictional engagement with the docks before the docks will move out of their docking position. However, since the user's hands and upper limbs are occupied with the lifting motion, and because the docks are biased toward their docking positions, means must be provided for the action of the user in lifting the sets of outrigger arms to result in movement of the docks away from their docking positions. This is accomplished in the present invention by initially activating means for moving the docks away from their docking position such that the bias of the docks toward their docking positions is overcome, but not overcome to the extent that the docks will move against their frictional engagement with their respective movable component. This function is supplied in part by the connector mechanism 320.

In the operation of the docking apparatus of the present invention, the user mounts the exercise machine, lying on their back on the bench 264. Thereupon, the user places their feet on the footboards, causing the footboards to be depressed and, acting through the cross member 310 and the lever arm 314 fixed thereto, apply a force to the connector mechanism 320 which tends to stretch an extensible element 321 associated with the connector mechanism 320 and develop stored energy therein. This stored energy is transferred through the connector mechanism 320 to the lateral arms 324 and 326 which are in position adjacent the docks 328 and 330 for engaging the docks and moving them away from their docking positions. This stored energy is less than that which will overcome the frictional forces existing between the docks and their respective set of outrigger arms when the outrigger arms are resting on the outboard ends of the docks, so that depression of the footboards does not effect release of the docks, but rather such depression of the footboards serves to "activate" the docking mechanism. Thereafter, upon release of the frictional engagement of the movable components (i.e. arms 402 and 418) with their respective docks, the energy stored in the extensible element takes over, moving the connector mechanism 320 forwardly and pivots the docks away from their docking positions. Thereafter, so long as the footboards are depressed, the docks are held away from their docking positions. However, upon the user removing his feet from the footboards, the energy imparted to the docking mechanism by the initial depression of the footboards is released, and the connector and the lateral arms 324 and 326 are free to move rearwardly such that the arms no longer engage the docks, whereupon the docks return to their docking positions under the bias provided to the docks by gravity or spring return means or the like. Preferably, this rearward movement of the connector mechanism 320 is aided by means of a spring or like means 354, which is provided between an anchor point 350 on the base 250 and a further anchor point 352 on the connector mechanism. Importantly, the force which this spring means 354 is capable of applying to the connector mechanism is selected to be less than that force which would overcome the force applied to the connector mechanism 320 upon depression of the footboards, so that depression of the footboards remains capable of imparting sufficient stored energy to the connector mechanism to move the connector mechanism forward against the return force imparted by the spring means 354, when the sets of outrigger arms are moved out of frictional engagement with the docks.

By reason of the fact that the present invention merely activates the possibility of the docks being moved from their docking positions, as opposed to actually moving the docks, inadvertent depression of the footboards will not release the docks. But rather, only the positive action of the user in lifting the sets of outrigger arms will result in actual movement of the docks. This provides a simple means for controlling the operation of the docking mechanism and provides a large measure of safety to the docking operation, as well as giving the user full control over the release of the docks.

Further, the use of pivotable footboards as the means by which the docking mechanism is activated, the control over the docking mechanism is under the control of a part of the user's body which is not primarily used in physically moving the movable component or components of the exercise machine. In the depicted embodiment, the user's lower limbs, which are not used in the exercise of the upper torso, provide the means for activating the docking mechanism. Activation of the docking mechanism may be placed under the control of other of the user's body parts depending upon the exercise routine being carried out and the exercise machine being used. For example, the operational principles of the present invention may be applied to an exercise machine for exercising the legs and where the user is expected to commence the exercise from an open position. Similarly, the present invention is suitable for use with a squat exercise machine such as that described in U.S. Pat. Nos. 4,872,670 and 5,108,095. In these machines, the footboards would be positioned on the deck of the machine so that when the user stepped into position on the machine, he would activate the docking mechanism. Thereafter, lifting of the backboard of the squat machine would release the frictional engagement of the dock with the backboard and thereby release the dock.

In accordance with one aspect of the present invention, the maximum limit of depression of the footboards, hence the degree of energy stored in the connector mechanism 320, may be limited as by stops 360 and 362 mounted on the base 250 and extending upwardly to be engaged by the footboards as they are depressed. Similarly, the maximum lower limit of movement of the sets of outrigger arms may be selected through the means of other stops 364 and 366 mounted on the base 250 and projecting upwardly to be engaged by the lower arms 402 and 418 of the sets of outrigger arms to thereby halt the downward movement of the sets of outrigger arms. The stops for the footboards and/or the stops for the sets of outrigger arms may be made adjustable in height if desired.

Alternatively, each dock may be made adjustable in height if desired, to permit the user to initially select the upper limit of the open position which is desired by the user.

In the method of the present invention, a dock is disposed in position with respect to a movable component or components of an exercise machine, the dock being movable between docking and nondocking positions with respect to the movable component or components. An activator is associated with the machine and in proximity to and operable by a body part of the user other than the body part which is primarily involved in the physical control of the movement of the movable component or components of the machine whereby initial physical movement of the activator initiates the possibility of movement of the dock away from its docking position. Between the activator and the dock there is disposed a connector mechanism. Physical movement of the activator is converted into a physical bias of the connector mechanism toward a position which caused the connector mechanism to urge the dock away from its docking position. The degree of physical bias transmitted to the connector mechanism is limited to a value which is less than that bias which is sufficient to permit the connector mechanism to move the dock away from its docking position so long as the dock is in frictional engagement with the movable component or components of the machine.

In one aspect of the method, the dock is biased toward its docking position. In another aspect of the method, the conversion of the physical movement of the activator to a bias of the connector mechanism is effected through a resiliently extensible member disposed between the activator and the connector mechanism whereby physical movement of the activator imparts a force upon the extensible member which tends to extend the member. This extension of the extensible member is limited by limiting the maximum extent of physical movement of the activator so that the extension force applied to the extensible member is less than the force required to permit the connector mechanism to move the dock from its docking position so long as the dock is in frictional engagement with the movable component or components of the machine.

Other aspects and advantages of the invention will be apparent to one skilled in the art given the description provided herein and the invention is intended to be limited only to the extent of the claims appended hereto.

What is claimed:

1. Apparatus for docking of a movable component or components of an exercise machine wherein the movable component or components are biased toward a docked position thereof comprising:

support means providing for mounting of the movable component or components of the exercise machine, dock means pivotally mounted on said support means in position with respect to the movable component or components of the exercise machine to limit the movement of the component or components against the bias of the movable component or components, said dock means being movable between docking and nondocking positions with respect to the movable components or components, and being in frictional engagement with the movable component or components when in its docking position and out of frictional engagement with the movable component or components when in its nondocking position, activator means mounted on said support means and in such proximity to said dock means as provides for an initial physical movement of said activator means to initiate only the possibility of movement of said dock means away from its docking position, connector mechanism means interposed between said activator means and said dock means, said connector mechanism means including a resilient extensible member having opposite ends, one of said ends being connected to said activator means and the other of said ends being connected to said connector mechanism means whereby physical movement of said activator means serves to extend said extensible member and develop stored energy therein, whereupon the initial physical movement of said activator means is converted into a physical bias of said connector mechanism means toward a position which causes said connector mechanism means to urge said dock means away from its docking position and said physical bias is transmitted to said dock means, the degree of said physical bias transmitted to said connector mechanism means being limited to a value which is less than that bias which is sufficient to permit the connector mechanism means to move said dock means away from its docking position so long as said dock means is in frictional engagement with the movable component or components but which is sufficient to move said dock means to its nondocking position when said dock means is not in frictional engagement with the movable component or components.

2. The apparatus of claim 1 and including means biasing said dock means toward its docking position.

3. The apparatus of claim 1 wherein said activator means includes at least one pivotally mounted platform whose pivotal movement physically imparts stored energy to said connector mechanism.

4. The apparatus of claim 3 wherein the extent of pivotal movement of said platform determines the degree of stored energy imparted to said connector mechanism and the maximum extent of pivotal movement of said platform is limited to that which only permits the connector mechanism to function to move the dock from its docking position when the dock is out of frictional engagement with the movable component or components.

5. The apparatus of claim 1 and including means biasing said connector mechanism toward a position thereof which permits the movement of said dock to its docking position, the degree of bias applied to said connector mechanism by said biasing means being insufficient to overcome the stored energy imparted to said extensible member associated with said connector mechanism by said activator so that said connector mechanism can only move to permit said dock to move to its docking position when the stored energy imparted to said connector mechanism by said activator is less than the bias applied to said connector mechanism by said biasing means.

6. The apparatus of claim 5 wherein said means biasing said connector mechanism toward a position thereof which permits the movement of said dock to its docking position is in the nature of a coiled spring.

* * * * *